United States Patent [19]

Colato et al.

[11] Patent Number: 4,539,455

[45] Date of Patent: Sep. 3, 1985

[54] ADJUSTABLE SHELF FOR MICROWAVE OVENS

[75] Inventors: Albert E. Colato, Valencia, Calif.; James F. Pomroy, St. Paul, Minn.

[73] Assignee: Plastics, Inc., St. Paul, Minn.

[21] Appl. No.: 484,851

[22] Filed: Apr. 14, 1983

[51] Int. Cl.[3] ..... H05B 6/64

[52] U.S. Cl. ..... 219/10.55 E; 108/19; 99/450

[58] Field of Search ..... 219/10.55 E; 99/448, 99/499, 450; 312/243; 108/19, 127

[56] References Cited

U.S. PATENT DOCUMENTS

| | | | |
|---|---|---|---|
| 2,329,213 | 9/1943 | Neutra et al. | 108/19 |
| 2,843,437 | 7/1958 | Dorsey et al. | 108/19 |
| 4,106,413 | 8/1978 | Hoaglund | 108/19 X |
| 4,249,464 | 2/1981 | Hansen | 99/450 |

FOREIGN PATENT DOCUMENTS

| | | | |
|---|---|---|---|
| 1282396 | 12/1961 | France | 108/19 |
| 5383 | of 1914 | United Kingdom | 108/19 |

*Primary Examiner*—Roy N. Envall, Jr.
*Assistant Examiner*—M. M. Lateef
*Attorney, Agent, or Firm*—Flehr, Hohbach, Test, Albritton & Herbert

[57] ABSTRACT

Adjustable shelf for use in microwave ovens. The shelf includes a horizontally extending platform and a plurality of legs which can be moved into different positions to support the platform at different heights above a supporting surface.

13 Claims, 7 Drawing Figures

ADJUSTABLE SHELF FOR MICROWAVE OVENS

This invention pertains generally to microwave ovens, and more particularly to an adjustable shelf structure for use in a microwave oven.

BACKGROUND OF THE INVENTION

Copending application Ser. No. 47,016, filed June 11, 1979, discloses a shelf structure and method for cooking two food products at different rates in a microwave oven. The shelf structure is placed on the rotating platform of a turntable in the oven cavity, and food products placed on the shelf cook at a different rate than food products placed directly on the turntable platform because of differences in the distribution of microwave energy at different heights in the cavity. While this shelf structure provides significant advantages in the simultaneous cooking of more than one food product in a microwave oven, it has certain limitations in that the shelf platform is always at a single fixed height and the structure which supports the platform can limit the size of food products which can be placed on the turntable platform when the shelf structure is in use.

SUMMARY OF THE INVENTION p It is in general an object of the invention to provide a new and improved shelf structure for use in a microwave oven.

Another object of the invention is to provide a shelf structure of the above character which is adjustable so that food products can be positioned at different heights above a supporting surface in the oven cavity.

Another object of the invention is to provide a shelf structure of the above character which can be mounted either on the rotating platform of a turntable or in a position straddling the turntable.

Another object of the invention is to provide a shelf structure of the above character which can be removed from the oven and used as a serving trivet.

These and other objects are achieved in accordance with the invention by providing a shelf structure having a horizontally extending platform supported by a plurality of legs which rest on a supporting surface in the oven cavity. The legs are pivotally connected to the platform and formed with sections of different lengths which can be selectively moved into a supporting position between the platform. In one position, the supporting sections of the legs rest upon the rotating platform of a turntable, and in another position the supporting sections are offset in an outward direction and straddle the turntable so that the shelf structure rests in a stationary position on the floor of the oven cavity.

DESCRIPTION OF THE PREFERRED EMBODIMENTS

Figure 1:
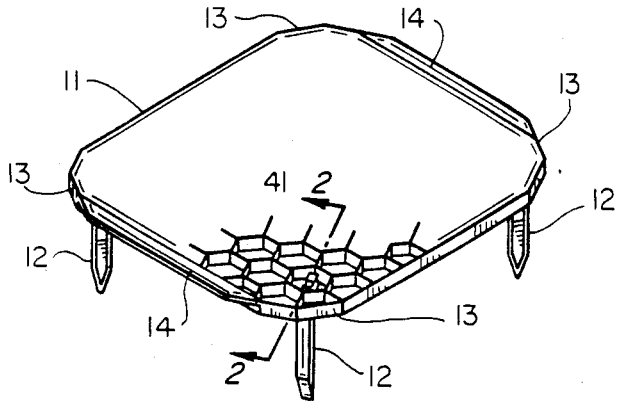
FIG. 1 is an isometric view of one embodiment of a shelf structure according to the invention.

The shelf structure comprises a horizontally extending platform 11 and a plurality of depending legs 12 which can be moved between different positions to support the platform at different heights above a supporting surface such as the floor of a microwave oven cavity or the platform of a turntable in the oven cavity.

Platform 11 and legs 12 are each fabricated of a material suitable for use in a microwave oven, e.g., a material which has a low loss tangent at microwave frequencies and does not interfere with the distribution of microwave energy in the oven cavity. Suitable materials include a modified thermosetting polyester as used in MICROWARE cookware developed by Plastics, Inc., a subsidiary of Anchor Hocking Corp.; polysulfone; thermoplastic polyesters; polypropylene; polycarbonate; polystyrene; acrylonitrile; butadiene styrene; polyphenylene oxide; acrylic, polyethylene and other materials.

Platform 11 has a generally rectangular contour in plan view, with beveled corners 13 and laterally projecting handles 14 at opposite ends thereof. In the embodiment illustrated, the platform has a honeycomb structure, with each section or cell of the honeycomb being hexagonal in shape. The honeycomb structure has certain advantages over a solid platform structure for use in a microwave oven, including better circulation of the microwave energy around the platform, minimal absorption of microwave energy by the platform, minimal heat transfer between the platform and the foot products carried thereby and better air circulation around the food products. The honeycomb structure also provides good strength and rigidity, with reduced weight and less material than a solid platform. The platform can have any suitable size and shape, for example, a length of about 11 inches, a width of about 9½ inches, and a thickness of about ½ inch, with a wall thickness of about ⅛ inch for the honeycomb structure. With these dimensions, the shelf structure can be rotated on a turntable in most ovens, and it can be used in a stationary mode in virtually all microwave ovens.

Each of the legs 12 has a long section 21 and a short section 22 which are generally perpendicular to each other and can be selectively moved into supporting positions beneath the platform. The leg is pivotally connected to the platform toward one end of short leg section 22, and the long leg section 21 extends from the free end of the short leg section, with a foot 23 being formed at the junction of the two leg sections. Each leg has an I-beam structure in cross-section.

A pivot head 26 is formed at the end of leg section 22 opposite foot 23, and an axle 27 projects laterally from opposite sides of the pivot head. The outer ends of the axle are pivotally received in sockets 28 formed in a pair of generally parallel flanges 29 which depend from opposite walls 31 of one of the honeycomb cells toward each corner of the platform. The orientation of the axle and the flanges is such that the leg pivots generally toward and away from the corner in which it is located.

Each of the sockets 28 is formed by a pair of intersecting slots 33, 34 on opposite sides of flange 29 and wall 31. Slot 33 is formed in the inner face of flange 29 and extends in an upward direction from the lower edge of the flange, terminating in a rounded upper wall 33a which forms the upper side of the socket. Slot 34 is formed in the outer surface of flange 29 and wall 31, and it extends in a downward direction from the upper edge of wall 31, terminating in a rounded lower wall 34a which forms the lower side of the socket. Slot 33 is wider than slot 34, and axle 27 is formed with portions of different diameters which are received in the portions of the socket which are formed by the respective slots.

The legs are installed with a snapping action through slots 33, with flanges 29 being deflected away from each other until the outer ends of the axle are seated in their respective sockets. To facilitate the insertion of the legs and the separation of flanges 29, the outer walls of slots 33 are formed with inclined ramps 36 at the lower ends thereof.

Figure 2:
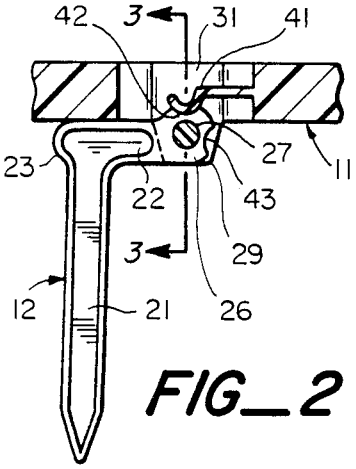
FIG. 2 is an enlarged fragmentary sectional view taken along line 2—2 in FIG. 1.
Figure 3:
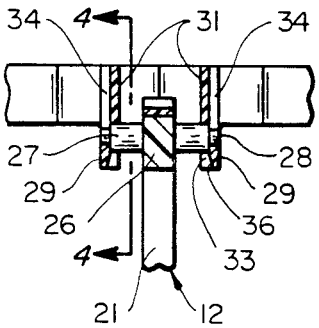
FIG. 3 is a cross-sectional view taken along line 3—3 in FIG. 2.
Figure 4:
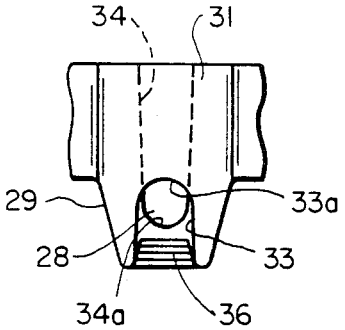
FIG. 4 is an enlarged cross-sectional view taken along line 4—4 in FIG. 3, with the leg removed for clarity of illustration.
Figure 5:
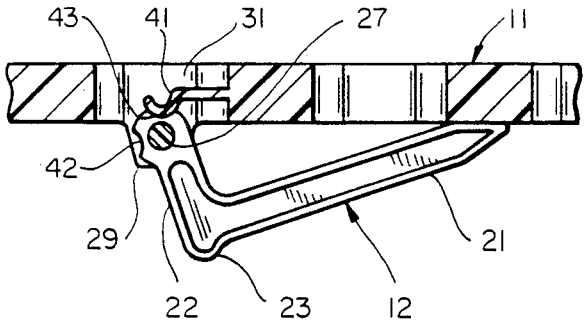
FIG. 5 is a fragmentary sectional view similar to FIG. 2, illustrating one of the legs of the shelf structure in an alternate position.

Referring now to FIGS. 2 and 5, it can be seen that legs 12 can be moved selectively between two supporting positions. In the position illustrated in FIG. 2, the short section 22 of the leg extends horizontally beneath platform 11, and long leg section 21 extends vertically, with the platform being supported by the longer leg section. In this position, it will be noted that the leg is offset outwardly from axle 27 and that the lower surface of the platform bears against the upwardly facing surface of leg section 22. In the position illustrated in FIG. 5, the longer leg section 21 is folded inwardly beneath the platform, and the leg rests upon the foot 23 at the junction of the two leg sections. Leg section 22 is inclined inwardly from pivot axle 27, and the free end of leg section 21 rests against the lower surface of the platform.

With the legs in the position illustrated in FIG. 5, the platform is supported closer to the supporting surface than when the legs are in the position illustrated in FIG. 2.

Means is provided for retaining the legs in their respective supporting positions. This means includes a resilient detent arm 41 affixed to the platform and a pair of detent sockets 42, 43 formed in the pivot head portion of the leg. Arm 41 is formed as an integral part of the platform and extends in a generally diametric direction across the honeycomb cell where the leg is mounted. Sockets 42, 43 are positioned for engagement by the detent arm when the leg is in its respective positions.

Figure 6:
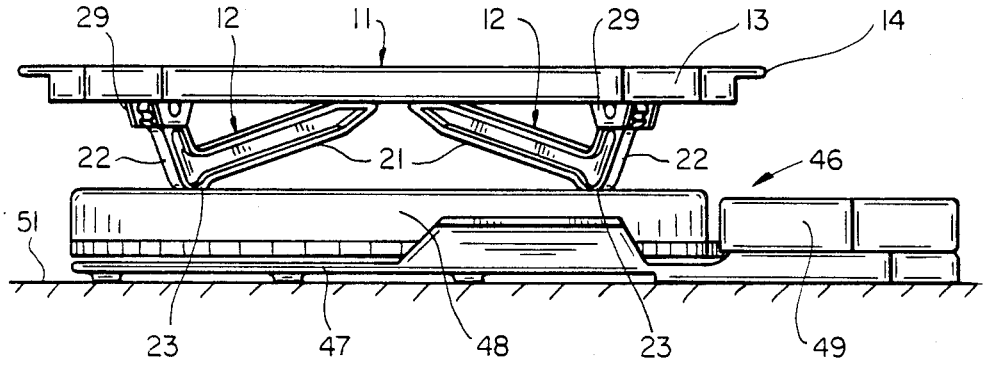
FIGS. 6 and 7 are side elevational views illustrating the shelf structure of FIGS. 1–5 in use with a turntable in a microwave oven.
Figure 7:
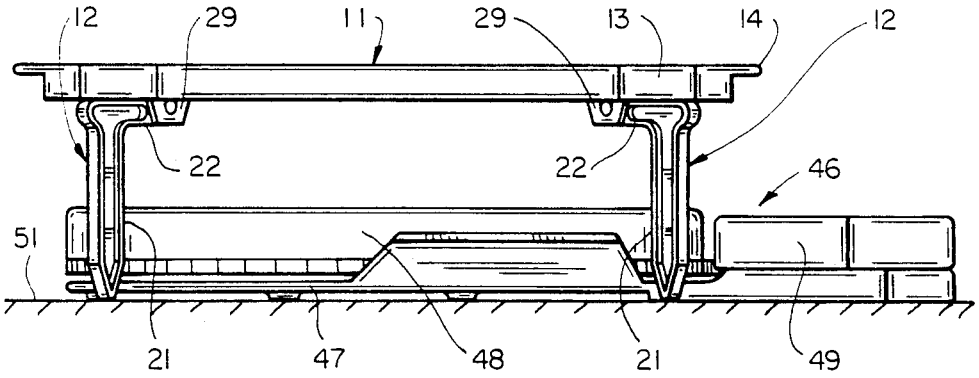

In FIGS. 6 and 7, the shelf structure is illustrated in combination with a portable microwave oven turntable 46 which has a generally planar base 47, a platform 48 rotatively mounted on the base, and a drive motor assembly 49 mounted on the base to one side of the platform for turning the platform about its axis. Suitable turntables are described in detail in U.S. Pat. No. 4,330,696 and in copending application Ser. No. 397,326, filed July 12, 1982.

Operation and use of the shelf structure are best described with reference to FIGS. 6 and 7. The turntable and the shelf structure are placed in the cooking cavity of a microwave oven, with the turntable resting on the floor 51 of the oven cavity. As illustrated in FIG. 6, the legs 12 of the shelf structure are folded beneath the platform 11, with feet 23 resting upon the platform 48 of the turntable so that the shelf platform is in its low position. The shelf structure and food products carried thereby rotate with the turntable, and if desired, additional food products can be placed on the turntable platform beneath the shelf.

In the arrangement illustrated in FIG. 7, legs 12 straddle the turntable 46 and rest directly upon the floor 51 of the oven cavity with platform 11 in its high position. The shelf structure thus remains in a stationary position as the turntable rotates, and food products carried by the shelf structure remain in a fixed position, while food products carried by the turntable rotate.

Depending upon the relative dimensions of the shelf structure and the turntable platform, the shelf structure can also be mounted on the turntable platform when the legs are in the extended position shown in FIGS. 2 and 7. With a 9 inch turntable platform and the dimensions given above for the shelf structure, the legs will straddle the turntable as shown in FIG. 7. However, with either a turntable of larger diameter or a shelf structure with a closer leg spacing, leg sections 21 will rest on the upper surface of the turntable platform. This places the shelf platform 11 at a greater height above the floor of the oven cavity and permits taller food products to be placed on the turntable platform beneath the shelf. Since the legs of the shelf structure are offset outwardly toward the edges of the shelf structure, food products of greater lateral extent can be placed on the turntable platform than would be possible without the offset.

In another method of use, the shelf structure can be placed over a cooking vessel, with the under side of the shelf resting upon and supported by the vessel. This mode of use is particularly useful where the lower cooking vessel is taller than the legs of the shelf.

The shelf structure can be removed from the oven and used as a serving trivet for supporting hot dishes on a table or other surface.

It is apparent from the foregoing that a new and improved shelf structure has been provided for use in microwave ovens. While only one presently preferred embodiment has been described in detail, as will be apparent to those familiar with the art, certain changes and modifications can be made without departing from the scope of the invention as defined by the following claims.

We claim:

1. A shelf for use in a microwave oven cavity comprising a horizontally extending platform, a plurality of legs which depend from the platform and rest upon a supporting surface in the oven cavity, each of said legs having two sections of different lengths extending in different directions, means pivotaly connecting the legs to the platform and permitting movement of the legs between two predetermined positions in which the platform is supported at different heights above the supporting surface by respective ones of the leg sections, and detent means comprising a resilient detent arm carried by the platform and a pair of detent sockets mounted on each of the legs in position for engagement by the detent arm when the legs are in respective ones of the predetermined positions.

2. The shelf of claim 1 wherein the horizontally extending platform has a honeycomb structure.

3. The shelf of claim 1 wherein each of the legs is pivotally connected to the platform toward one end of the shorter section of the leg, and the longer section of the leg extends in a generally perpendicular direction from the other end of the shorter section, said longer section being offset outwardly from the pivotal connection when in position to support the platform and being folded beneath the platform when the platform is supported by the shorter leg section.

4. The shelf of claim 1 wherein the legs are provided with laterally extending axles, and the platform has depending flanges with sockets in which the axles are received.

5. The shelf of claim 1 wherein the legs rest upon the floor of the oven cavity.

6. Apparatus for use in a microwave oven cavity, comprising a rotatively driven turntable platform positioned near the floor of the oven cavity, a horizontally extending shelf member positioned above the platform, and a plurality of supporting legs depending from the shelf member and being selectively movable between a first position in which the legs rest upon the turntable platform and a second position in which the legs straddle the platform and rest upon the floor of the oven cavity, said shelf member rotating with the platform when the legs are in the first position and remaining stationary when the legs are in the second position.

7. The apparatus of claim 6 wherein each of the legs has two sections of different lengths, and means pivotally connecting the leg to the shelf member so that the legs can be selectively positioned with the shorter leg sections resting upon the turntable platform or the longer leg sections resting upon the floor of the oven cavity.

8. The apparatus of claim 7 wherein the longer section of each leg extends in a direction generally perpendicular to the shorter section, and each leg is pivotally connected to the shelf member toward one end of the shorter section.

9. The apparatus of claim 7 including detent means for holding the legs in the two positions.

10. The apparatus of claim 9 wherein the detent means includes a detent arm carried by the shelf member and a pair of detent sockets on each of the legs for engagement with the detent arm when the leg is in the first and second positions.

11. The apparatus of claim 6 wherein the shelf member has a honeycomb structure.

12. A shelf for use in a microwave oven cavity, comprising a horizontally extending platform, a plurality of legs which depend from the platform and rest on a supporting surface in the oven cavity, each of said legs having a longer section and a shorter section generally perpendicular to each other and a foot at the junction of the two sections, means including a pivot head at the ree end of each of the shorter leg sections for pivotally mounting the legs to the platform for movement between a first position in which the free ends of the longer leg sections rest upon the supporting surface and a second position in which the feet at the junctions of the leg sections rest upon the supporting surface, the shorter leg sections extending outwardly from the pivot heads and engaging the underside of the platform when the legs are in the first position, the longer leg sections extending inwardly and upwardly from the feet when the legs are in the second position with the free ends of the longer leg sections engaging the underside of the platform, and detent means for holding the legs in the first and second positions, said detent means comprising a resilient detent arm carried by the platform and a pair of detent sockets formed in each of the pivot heads for engagement by the detent arm when the legs are in the first and second positions.

13. The shelf of claim 12 wherein the horizontally extending platform has a honeycomb structure.

* * * * *